US008293376B2

(12) United States Patent
Liu et al.

(10) Patent No.: US 8,293,376 B2
(45) Date of Patent: Oct. 23, 2012

(54) METAL-COATED STEEL STRIP

(75) Inventors: Qiyang Liu, Mount Keira (AU); David Willis, Albion Park (AU)

(73) Assignee: Bluescope Steel Limited, Melbourne (AU)

( * ) Notice: Subject to any disclaimer, the term of this patent is extended or adjusted under 35 U.S.C. 154(b) by 1057 days.

(21) Appl. No.: 11/910,768

(22) PCT Filed: Apr. 5, 2006

(86) PCT No.: PCT/AU2006/000446

§ 371 (c)(1),
(2), (4) Date: Apr. 10, 2008

(87) PCT Pub. No.: WO2006/105593

PCT Pub. Date: Oct. 12, 2006

(65) Prior Publication Data

US 2009/0011277 A1 Jan. 8, 2009

(30) Foreign Application Priority Data

Apr. 5, 2005 (AU) ..... 2005901670

(51) Int. Cl.

| | |
|---|---|
| ***B32B 15/20*** | (2006.01) |
| ***B32B 15/01*** | (2006.01) |
| ***B32B 15/18*** | (2006.01) |
| ***C23C 2/02*** | (2006.01) |
| ***C23C 2/12*** | (2006.01) |

(52) U.S. Cl. ..... 428/548; 428/653; 428/681; 427/319; 427/436

(58) Field of Classification Search ..... None
See application file for complete search history.

(56) References Cited

U.S. PATENT DOCUMENTS

| | | | | |
|---|---|---|---|---|
| 4,401,727 | A | 8/1983 | Berke et al. | |
| 4,610,936 | A * | 9/1986 | Isobe et al. | 428/659 |
| 4,913,785 | A * | 4/1990 | Uchida et al. | 205/193 |
| 5,853,806 | A * | 12/1998 | Higuchi et al. | 427/310 |
| 2009/0269611 | A1 * | 10/2009 | Liu et al. | 428/653 |
| 2010/0021760 | A1 * | 1/2010 | Liu et al. | 428/653 |

FOREIGN PATENT DOCUMENTS

| | | | |
|---|---|---|---|
| JP | 58006965 | A | 1/1983 |
| JP | 09209109 | | 8/1997 |
| JP | 11222658 | | 8/1999 |
| JP | 11310862 | | 11/1999 |
| JP | 11350164 | | 12/1999 |
| JP | 2000328214 | A | 11/2000 |
| JP | 2001089838 | A | 4/2001 |
| JP | 2001316791 | A | 11/2001 |
| JP | 2002012959 | A | 1/2002 |
| WO | 2004/038060 | * | 5/2004 |
| WO | 2004/083480 | * | 9/2004 |
| WO | 2004083480 | * | 9/2004 |
| WO | 2005052209 | A1 | 6/2005 |

OTHER PUBLICATIONS

Written Opinion of the International Searching Authority for PCT/AU2006/000446 dated May 11, 2006.

* cited by examiner

*Primary Examiner* — Jennifer McNeil
*Assistant Examiner* — Jason Savage
(74) *Attorney, Agent, or Firm* — Michael Best & Friedrich LLP

(57) ABSTRACT

A steel strip having a metal coating on at least one surface of the strip. The coating includes an aluminum-zinc-silicon alloy containing magnesium and has small spangles. The magnesium concentration is between 1 and 5% by weight.

21 Claims, 4 Drawing Sheets

METAL-COATED STEEL STRIP

The present invention relates to steel strip that has a corrosion-resistant metal coating that is formed on the strip by hot-dip coating the strip in a molten bath of coating metal.

The present invention relates particularly but not exclusively to metal coated steel strip that can be cold formed (e.g. by roll forming) into an end-use product, such as roofing products.

The present invention relates more particularly but not exclusively to metal coated steel strip of the type described in the preceding paragraph that has a corrosion-resistant metal coating with small spangles, i.e. a coating with an average spangle size of the order of less than 0.5 mm.

The present invention relates more particularly but not exclusively to metal coated steel strip of the type described above that has a corrosion-resistant metal coating with small spangles and includes an aluminium-zinc-silicon alloy that contains magnesium.

The term "aluminium-zinc-silicon alloy" is understood herein to mean alloys comprising the following ranges in % by weight of the elements aluminium, zinc and silicon:

| | |
|---|---|
| Aluminium: | 45-60 |
| Zinc: | 37-46 |
| Silicon: | 1.2-2.3 |

Aluminium-zinc-silicon alloy coated steel strip products are sold by the applicant, by way of example, under the registered trade mark Zincalume.

The term "aluminium-zinc-silicon" alloy is also understood herein to mean alloys that may or may not contain other elements, such as, by way of example, any one or more of iron, vanadium, and chromium.

In the conventional hot-dip metal coating method, steel strip generally passes through one or more heat treatment furnaces and thereafter into and through a bath of molten coating metal, such as aluminium-zinc-silicon alloy, held in a coating pot.

The heat treatment furnaces may be arranged so that the strip travels horizontally through the furnaces.

The heat treatment furnaces may also be arranged so that the strip travels vertically through the furnaces and passes around a series of upper and lower guide rollers.

The coating metal is usually maintained molten in the coating pot by the use of heating inductors.

The strip usually exits the heat treatment furnaces via an outlet end section in the form of an elongated furnace exit chute or snout that dips into the bath.

Within the bath the strip passes around one or more sink rolls and is taken upwardly out of the bath and is coated with the coating metal as it passes through the bath.

After leaving the coating bath the metal coated strip passes through a coating thickness control station, such as a gas knife or gas wiping station, at which its coated surfaces are subjected to jets of wiping gas to control the thickness of the coating.

The metal coated strip then passes through a cooling section and is subjected to forced cooling.

The cooled metal coated strip may thereafter be optionally conditioned by passing the coated strip successively through a skin pass rolling section (also known as a temper rolling section) and a tension levelling section. The conditioned strip is coiled at a coiling station.

In general terms, the present invention is concerned with providing metal coated steel strip that is an improved product when compared with currently available products from the viewpoint of the combination of properties of corrosion resistance and ductility of the coating.

In more specific terms, the present invention is concerned with providing metal coated steel strip that is an improved product when compared with currently available products from the viewpoint of the combination of properties of corrosion resistance, ductility, and surface defects of the coating.

The term "surface defects" is understood herein to mean defects on the surface of a coating that are described by the applicant as "rough coating" and "pinhole-uncoated" defects.

Typically, a "rough coating" defect is a region that has a substantial variation in coating over a 1 mm length of strip, with the thickness varying between 10 micron thick and 40 micron thick.

Typically, a "pinhole-uncoated" defect is a very small region (<0.5 mm in diameter) that is uncoated.

The applicant believes that oxides on the surface of a molten bath are one major cause of the above-described surface defects. The surface oxides are solid oxides that are formed from metals in the molten bath as a result of reactions between molten bath metal and water vapour in the snout above the molten bath. The applicant believes that surface oxides are taken up by strip as the strip passes through the oxide layer as it enters the molten bath.

In general terms, the present invention provides a steel strip having a metal coating on at least one surface of the strip, which is characterised in that the coating includes aluminium-zinc-silicon alloy that contains magnesium and the coating has small spangles.

The magnesium addition to the aluminium-zinc-silicon alloy improves the corrosion resistance of the coating and the small spangle size improves the ductility of the coating and compensates for an adverse effect of magnesium on ductility of the coating.

The term "small spangles" is understood herein to mean metal coated strip that has spangles that are less than 0.5 mm, preferably less than 0.2 mm, measured using the average intercept distance method as described in Australian Standard AS1733.

Preferably the magnesium concentration is less than 8% by weight.

Preferably the magnesium concentration is less than 3% by weight.

Preferably the magnesium concentration is at least 0.5% by weight.

Preferably the magnesium concentration is between 1 and 5% by weight.

More preferably the magnesium concentration is between 1 and 2.5% by weight.

The aluminium-zinc-silicon alloy may contain other elements.

Preferably the aluminium-zinc-silicon alloy contains strontium and/or calcium.

The strontium and/or calcium addition to the aluminium-zinc-silicon alloy substantially reduces the number of the above-described surface defects and compensates for the increased number of the surface defects caused by magnesium.

The strontium and the calcium may be added separately or in combination.

The strontium and/or the calcium may be added in any suitable amounts.

Preferably the concentration of (i) strontium or (ii) calcium or (iii) strontium and calcium is at least 2 ppm.

Preferably the concentration of (i) strontium or (ii) calcium or (iii) strontium and calcium is less than 0.2 wt. %.

More preferably the concentration of (i) strontium or (ii) calcium or (iii) strontium and calcium to is less than 150 ppm.

Typically the concentration of (i) strontium or (ii) calcium or (iii) strontium and calcium is less than 100 ppm.

More preferably the concentration of (i) strontium or (ii) calcium or (iii) strontium and calcium is no more than 50 ppm.

In a situation in which the aluminium-zinc-silicon alloy contains strontium and no calcium, preferably the concentration of strontium is in the range of 2-4 ppm.

More preferably the strontium concentration is 3 ppm.

In a situation in which the aluminium-zinc-silicon alloy contains calcium and no strontium, preferably the alloy includes calcium in the range of 4-8 ppm.

More preferably the calcium concentration is 6 ppm.

In a situation in which the aluminium-zinc-silicon alloy contains strontium and calcium, preferably the concentration of strontium and calcium is at least 4 ppm.

Preferably the concentration of strontium and calcium is in the range of 2-12 ppm.

Preferably the aluminium-zinc-silicon alloy is a titanium boride-modified aluminium-zinc-silicon alloy such as described in International application PCT/US00/23164 (WO 01/27343) in the name of Bethlehem Steel Corporation. The disclosure in the specification of the International application is incorporated herein by cross-reference. The International application discloses that titanium boride minimises the spangle size of aluminium-zinc-silicon alloys.

Preferably the aluminium-zinc-silicon alloy does not contain vanadium and/or chromium as deliberate alloy elements—as opposed to being present in trace amounts for example due to contamination in the molten bath.

The present invention also provides a method of forming a metal coating on a steel strip which includes the steps of: successively passing the steel strip through a heat treatment furnace and a bath of molten aluminium-zinc-silicon alloy which includes magnesium as described above, and:

(a) heat treating the steel strip in the heat treatment furnace; and (b) hot-dip coating the strip in the molten bath and forming a coating of the alloy with small spangles on the steel strip.

Preferably the method includes controlling the concentration of (i) strontium or (ii) calcium or (iii) strontium and calcium in the molten bath to be at least 2 ppm.

Preferably the method includes controlling the concentration of (i) strontium or (ii) calcium or (iii) strontium and calcium to be less than 0.2 wt. %.

More preferably the method includes controlling the concentration of (i) strontium or (ii) calcium or (iii) strontium and calcium to be less than 150 ppm.

Typically, the method includes controlling the concentration of (i) strontium or (ii) calcium or (iii) strontium and calcium to be less than 100 ppm.

Preferably the method includes controlling the concentration of (i) strontium or (ii) calcium or (iii) strontium and calcium to be no more than 50 ppm.

The concentration of (i) strontium or (ii) calcium or (iii) strontium and calcium in the molten bath may be controlled by any suitable means.

One option, which is preferred by the applicant, is to specify a minimum concentration(s) of strontium and/or calcium in the aluminium that is supplied to form the aluminium-zinc-silicon alloy for the molten bath.

Another, although not the only other, option is to periodically dose the molten bath with amounts of strontium and/or calcium that are required to maintain the concentration(s) at a required concentration.

Small spangles may be formed by any suitable method steps, such as by adding titanium boride particles (which term includes powders) to the molten bath as described in International application PCT/US00/23164 (WO 01/27343) in the name of Bethlehem Steel Corporation.

Preferably the heat treatment furnace has an elongated furnace exit chute or snout that extends into the bath.

According to the present invention there is also provided cold formed products made from the above-described metal coated steel strip.

BRIEF DESCRIPTION OF THE DRAWINGS

The present invention was made during the course of research work carried out by the applicant and is described further by way of example with reference to the accompanying drawings of which.

EXAMPLES

Figure 1A:
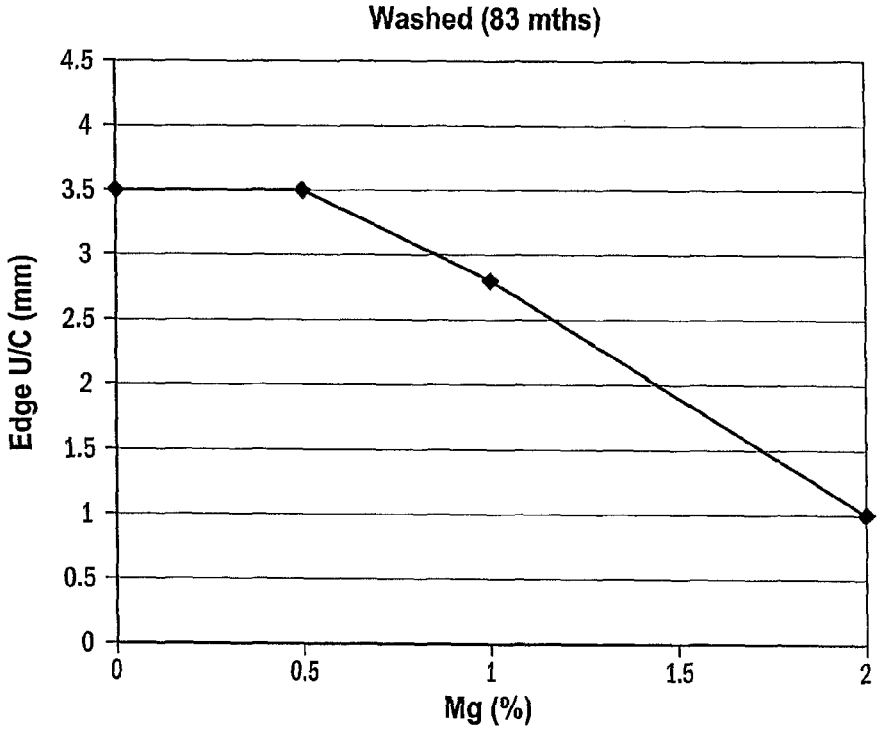
FIG. 1*a*, FIGS. 1*b*, and 2 are plots of edge undercutting versus magnesium concentration in aluminium-zinc-silicon alloys tested under different conditions.
Figure 1B:
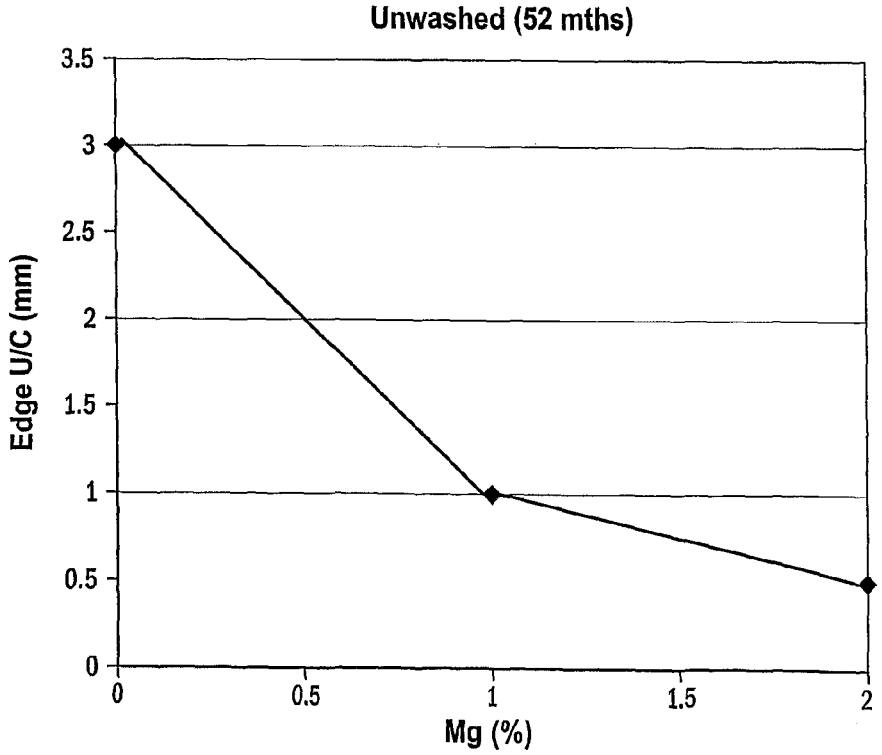
Figure 2:
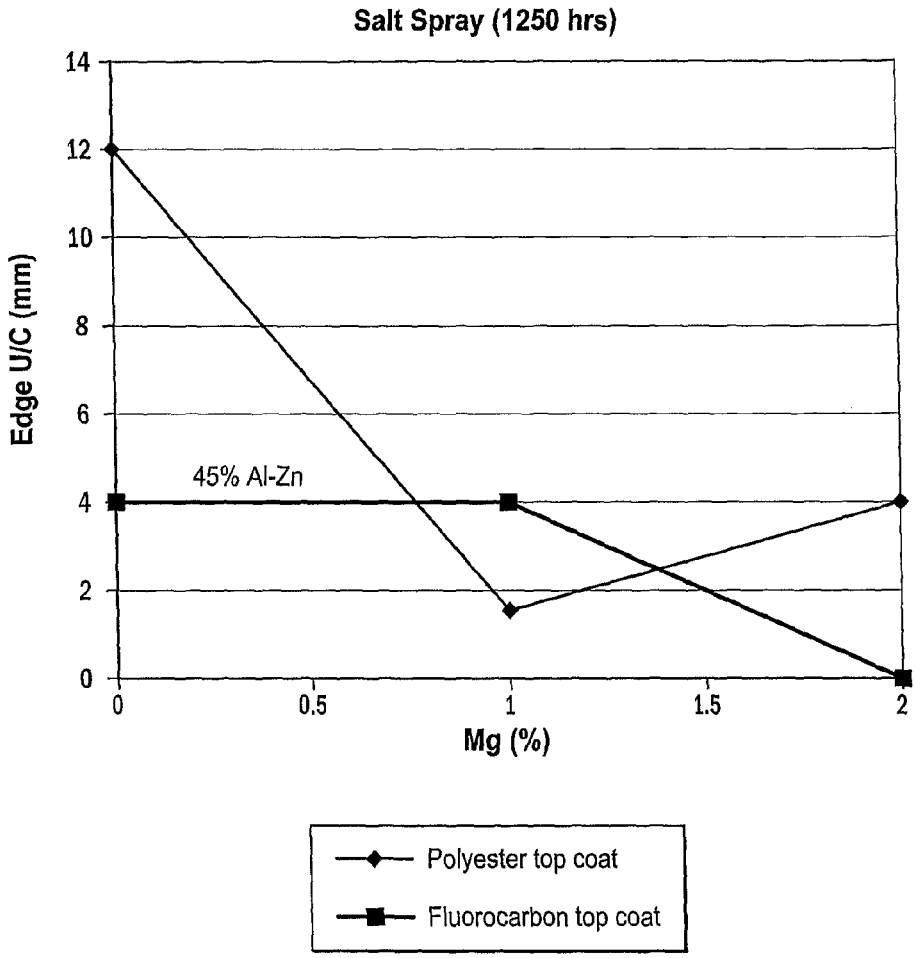
Figure 3:
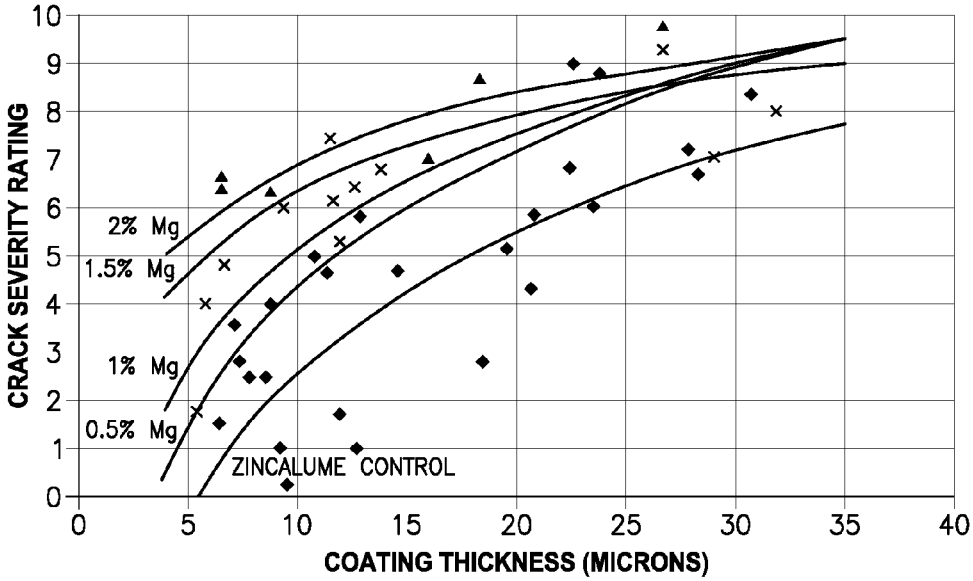
FIG. 3 is a plot of coating ductility (measured by a crack sensitivity rating) versus coating thickness for coatings of aluminium-zinc-silicon alloy containing different concentrations of magnesium.
Figure 4:
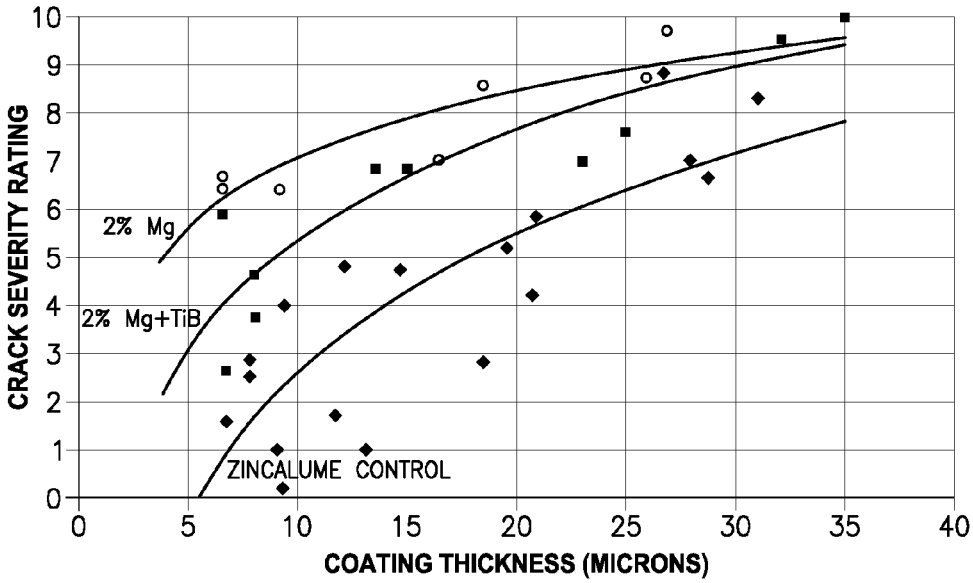
FIG. 4 is a plot of coating ductility (measured by a crack sensitivity rating) versus coating thickness for coatings of aluminium-zinc-silicon alloy containing the same concentration of magnesium and different spangle sizes.

The results of the experimental work presented in FIGS. 1 to 4 and described in more detail below indicate that:

(a) the addition of magnesium to an aluminium-zinc-silicon alloy improves the corrosion resistance of a coating of the alloy on a steel strip (FIGS. 1 and 2);

(b) the addition of magnesium to an aluminium-zinc-silicon alloy reduces the ductility of a coating of the alloy on a steel strip (FIG. 3); and (c) forming a coating of an aluminium-zinc-silicon-magnesium alloy with a small spangle size as opposed to a normal spangle size improves the ductility of the coating (FIG. 4).

(a) Impact of Magnesium on Corrosion Resistance

The corrosion resistance of coatings on steel strip test panels with different concentrations of magnesium in the coating compositions was assessed in (a) outdoor exposure tests and (b) salt spray tests.

The outdoor exposure tests were carried out on a series of panels of steel strip that were coated on the surfaces of the strip with Zincalume (55 wt % Al) containing 0 wt %, 0.5 wt %, 1.0 wt %, and 2.0 wt % Mg. A top surface of each of the metal coated panels was subjected to chromate pre-treatment and then painted firstly with a primer and then with a polyester top coat.

The outdoor exposure tests were carried out by positioning the panels at test sites of the applicant at Bellambi Point, New South Wales, Australia. The Bellambi Point site is rated as a severe marine environment. One set of panels was positioned to expose the painted surfaces to the rain, etc. Hence, the painted surfaces were washed with rainwater. A second set of panels was positioned in sheltered locations at the site so that the painted surfaces were not exposed directly to rain and, therefore, were not washed with rainwater. At the conclusion of the test periods of 83 months for the set of washed panels and 52 months for the unwashed panels, the panels were inspected visually and measurements were made to determine the edge undercutting of the paint layers caused by corrosion creep from the metal coated edges of the panels.

The results of the outdoor exposure tests are summarised in FIGS. 1(*a*) and 1(*b*). The Figures show that corrosion resistance of metal coated steel strip, as assessed by edge undercutting of paint surfaces, decreased with increasing magnesium concentration in the metal coating composition.

The salt spray tests were carried out on a series of panels of steel strip that were coated on the surfaces of the strip with Zincalume (55 wt % Al) containing 0 wt %, 1.0 wt %, and 2.0 wt % Mg. A top surface of each of the metal coated panels was subjected to chromate pre-treatment and then painted firstly with a primer and then with a polyester or a fluorocarbon top coat.

The salt spray tests were carried out in a standard laboratory accelerated corrosion test using salt spray in accordance with ASTM B117. The panels were tested for a period of 1250 hours. At the conclusion of the test period the panels were inspected visually and measurements were made to determine the edge undercutting of the paint layers caused by corrosion creep from the metal coated edges of the panels.

The results of the outdoor exposure tests are summarised in FIG. 2. The plot defined by the diamond data points relates to panels coated with a polyester top coat. The plot defined by the square data points relates to panels coated with a fluorocarbon top coat. The Figure shows that corrosion resistance of metal coated steel strip, as assessed by edge undercutting of paint surfaces, decreased with increasing magnesium concentration in the metal coating composition.

(b) Impact of Magnesium on Coating Ductility

The ductility of coatings on steel strip test pieces coated with a series of different coating compositions at different coating thicknesses was assessed using a standard method developed by the applicant.

The method comprised performing a 2T bend test on each test piece and then rating the coating crack severity on the bend using a set of rating standards, from Rating 0 (minimal cracking) to Rating 10 (most severe cracking), under an optical microscope with 15× magnification. Coating crack severity rating is described, by way of example, in Willis, D. J. and Zhou, Z. F., Factors Influencing the Ductility of 55% Al—Zn Coatings, Galvatech 19.95, pp 455-462.

The crack severity rating of coatings is a measure of the ductilities of the coatings, with higher ratings indicating lower coating ductilities.

The compositions of the trial coatings for this work and the work on assessing the impact of spangle size on coating ductility discussed in the next section of the specification are set out in Table 1 below.

TABLE 1

| | Composition (wt %) | | | | | | |
|---|---|---|---|---|---|---|---|
| Sample Description | Al | Zn | Si | Fe | Mg | B | Ti |
| Zincalume 1.5% Si (control) | 55.6 | 42.5 | 1.45 | 0.35 | — | — | — |
| Zincalume 1.5% Si + 0.5% Mg | 53.6 | 43.8 | 1.60 | 0.36 | 0.61 | — | — |
| Zincalume 1.5% Si + 1% Mg | 55.1 | 42.0 | 1.46 | 0.36 | 1.00 | — | — |
| Zincalume 1.5% Si + 1.5% Mg | 54.2 | 42.3 | 1.50 | 0.37 | 1.57 | — | — |
| Zincalume 1.5% Si + 2% Mg | 53.7 | 42.5 | 1.52 | 0.39 | 1.91 | — | — |
| Zincalume 1.5% Si + 2% Mg, 0.015% Ti | 51.2 | 38.3 | 1.42 | 0.38 | 2.17 | 0.002 | 0.016 |

As is noted above, Zincalume is a registered trade mark of the applicant that is used in connection with aluminium-zinc-silicon alloy coated steel strip products.

The compositions in the columns under the heading "Composition" in Table 1 were determined by wet chemical analysis using the Inductively Coupled Plasma Spectrometry (ICP) technique. The details in the Sample Description column in the Table represent the target pot composition for each respective trial coating.

The results of the ductility tests for the Zincalume control coating (0 wt. % Mg) and Zincalume alloys with 0.5, 1.0, 1.5, and 2.0 wt. % Mg are summarised in FIG. 3.

It is evident from FIG. 3 that the ductility of the coating decreased with increasing Mg concentration in the Zincalume coating.

(c) Impact of Spangle Size on Ductility

The impact of spangle size on ductility was assessed using test pieces coated with a series of different coating compositions at different coating thicknesses.

Specifically, with reference to Table 1 above, the test pieces were coated with (a) the Zincalume control and having a "normal" size spangle, (b) Zincalume with 2 wt. % Mg having a "normal" size spangle, and (c) Zincalume with 2 wt. % Mg and TiB and having a "small" spangle size.

The ductility of the test pieces was assessed using the same test method described above.

The results of the ductility tests are summarised in FIG. 4.

It is evident from FIG. 4 that forming the coating of Zincalume with 2 wt. % Mg with a "small" spangle size improved the ductility of the coating when compared to the ductility of the coating of the same composition but a "normal" spangle size.

Figure 5:
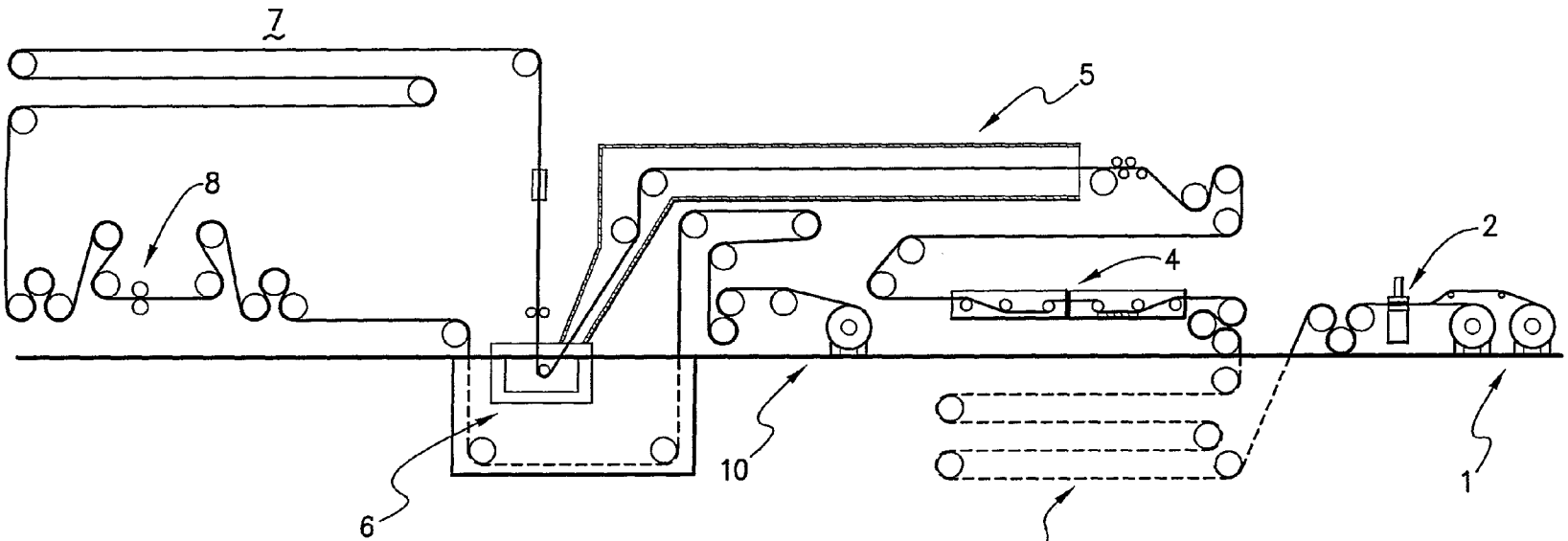
FIG. 5 is a schematic drawing of one embodiment of a continuous production line for producing steel strip coated with aluminium-zinc-silicon alloy in accordance with the method of the present invention.

FIG. 5 is a schematic drawing of one embodiment of a continuous production line for producing steel strip coated with aluminium-zinc-silicon alloy in accordance with the method of the present invention.

With reference to FIG. 5, in use, coils of cold rolled steel strip are uncoiled at an uncoiling station 1 and successive uncoiled lengths of strip are welded end to end by a welder 2 and form a continuous length of strip.

The strip is then passed successively through an accumulator 3, a strip cleaning section 4 and a furnace assembly 5. The furnace assembly 5 includes a preheater, a preheat reducing furnace, and a reducing furnace.

The strip is heat treated in the furnace assembly 5 by careful control of process variables including: (i) the temperature profile in the furnaces, (ii) the reducing gas concentration in the furnaces, (iii) the gas flow rate through the furnaces, and (iv) strip residence time in the furnaces (i.e. line speed).

The process variables in the furnace assembly 5 are controlled so that there is removal of iron oxide residues from the surface of the strip and removal of residual oils and iron fines from the surface of the strip.

The heat treated strip is then passed via an outlet snout downwardly into and through a bath containing a molten alloy held in a coating pot 6 and is coated with the alloy.

The alloy is an aluminium-zinc-silicon alloy that contains:

(a) less than 8 wt. % magnesium to contribute to corrosion resistance of the coating, (b) titanium borides to minimise spangle size of the coating, and (c) less than 0.2 wt. % strontium and calcium to minimise the number of the above-described surface defects.

Preferably the aluminium-zinc-silicon alloy does not contain vanadium and/or chromium.

The aluminium-zinc-silicon alloy is maintained molten in the coating pot by use of heating inductors (not shown).

Within the bath the strip passes around a sink roll and is taken upwardly out of the bath. Both surfaces of the strip are coated with the alloy in the bath as it passes through the bath.

The coating that forms on the strip in the molten bath is in the form of the aluminium-zinc-silicon alloy that contains magnesium and strontium and/or calcium.

The coating has a comparatively small number of the above-described surface defects due to the strontium and calcium.

The coating has small spangles due to the titanium boride.

After leaving the molten bath 6 the coated strip passes vertically through a gas wiping station (not shown) at which its coated surfaces are subjected to jets of wiping gas to control the thickness of the coating.

The coated strip is then passed through a cooling section 7 and subjected to forced cooling.

The cooled, coated strip, is then passed through a rolling section 8 that conditions the surface of the coated strip.

The coated strip is thereafter coiled at a coiling station 10.

Many modifications may be made to the preferred embodiment described above without departing from the spirit and scope of the present invention.

In particular, it is noted that the experimental work presented above is only a selection of the experimental work on the present invention carried out by the applicant. By way of particular example, the applicant has carried out experimental work on aluminium-zinc-silicon alloys containing concentrations of magnesium higher than 2 wt. % reported herein and up to 8 wt. % magnesium and the results on the work are consistent with the reported results herein.

The invention claimed is:

1. A steel strip having a metal coating on at least one surface of the strip, which is characterised in that the coating includes aluminium-zinc-silicon alloy that contains magnesium and the coating has small spangles, wherein the aluminium concentration is between 45 and 60% by weight and the magnesium concentration is between 2 and 5% by weight.

2. The strip defined in claim 1 wherein the magnesium concentration is between 2 and 3% by weight.

3. The strip defined in claim 1 wherein the magnesium concentration is between 2 and 2.5% by weight.

4. The strip defined in claim 1 wherein the aluminium-zinc-silicon alloy contains strontium and/or calcium.

5. The strip defined in claim 4 wherein the concentration of (i) strontium or (ii) calcium or (iii) strontium and calcium is at least 2 ppm.

6. The strip defined in claim 4 wherein the concentration of (i) strontium or (ii) calcium or (iii) strontium and calcium is less than 0.2 wt. %.

7. The strip defined in claim 4 wherein the concentration of (i) strontium or (ii) calcium or (iii) strontium and calcium is no more than 50 ppm.

8. The strip defined in claim 4 wherein, in a situation in which the aluminium-zinc-silicon alloy contains strontium and no calcium, the concentration of strontium is in the range of 2-4 ppm.

9. The strip defined in claim 4 wherein, in a situation in which the aluminium-zinc-silicon alloy contains calcium and no strontium, the alloy includes calcium in the range of 4-8 ppm.

10. The strip defined in claim 4 wherein, in a situation in which the aluminium-zinc-silicon alloy contains strontium and calcium, the concentration of strontium and calcium is at least 4 ppm.

11. The strip defined in claim 1 wherein the aluminium-zinc-silicon alloy is a titanium boride-modified aluminium-zinc-silicon alloy.

12. The strip defined claim 1 wherein the aluminium-zinc-silicon alloy does not contain vanadium and/or chromium as deliberate alloy elements—as opposed to being present in trace amounts for example due to contamination in the molten bath.

13. A method of forming the strip of claim 1, comprising:

(a) heat treating the steel strip in a heat treatment furnace; and (b) hot-dip coating the strip in a bath of molten aluminium-zinc-silicon alloy which includes magnesium.

14. The method defined in claim 13 includes controlling the concentration of (i) strontium or (ii) calcium or (iii) strontium and calcium in the molten bath to be at least 2 ppm.

15. The method defined in claim 13 includes controlling the concentration of (i) strontium or (ii) calcium or (iii) strontium and calcium to be less than 0.2 wt. %.

16. The method defined in claim 13 includes controlling the concentration of (i) strontium or (ii) calcium or (iii) strontium and calcium to be less than 150 ppm.

17. The method defined in claim 13 includes controlling the concentration of (i) strontium or (ii) calcium or (iii) strontium and calcium to be no more than 50 ppm.

18. The method defined in claim 13 includes specifying a minimum concentration(s) of strontium and/or calcium in the aluminium that is supplied to form the aluminium-zinc-silicon alloy for the molten bath.

19. The method defined in claim 13 includes periodically dosing the molten bath with amounts of strontium and/or calcium that are required to maintain the concentration(s) at a required concentration.

20. The method defined in claim 13 includes forming the coating with small spangles on the steel strip by adding titanium boride particles (which term includes powders) to the molten bath so that the molten aluminium-zinc-silicon alloy contains titanium boride.

21. Cold formed products made from a metal coated steel strip having a metal coating on at least one surface of the strip, which is characterised in that the coating includes aluminium-zinc-silicon alloy that contains magnesium and the coating has small spangles, wherein the aluminium concentration is between 45 and 60% by weight, and the magnesium concentration is between 2 and 5% by weight.

* * * * *